US006272830B1

(12) United States Patent
Morgan et al.

(10) Patent No.: US 6,272,830 B1
(45) Date of Patent: Aug. 14, 2001

(54) STEEL CORD FOR REINFORCING ELASTOMERIC ARTICLES

(75) Inventors: John Gomer Morgan, North Canton; Italo Marziale Sinopoli, Canton, both of OH (US)

(73) Assignee: The Goodyear Tire & Rubber Company, Akron, OH (US)

( * ) Notice: Subject to any disclaimer, the term of this patent is extended or adjusted under 35 U.S.C. 154(b) by 0 days.

(21) Appl. No.: 09/507,316

(22) Filed: Feb. 18, 2000

(51) Int. Cl.[7] ..... D07B 1/06

(52) U.S. Cl. ..... 57/213; 57/902; 152/556; 152/451; 152/527

(58) Field of Search ..... 57/213, 230, 902; 152/556, 451, 527

(56) References Cited

U.S. PATENT DOCUMENTS

| | | | | |
|---|---|---|---|---|
| 3,032,963 | * | 5/1962 | Fenner | 57/145 |
| 3,336,744 | * | 8/1967 | Peene | 57/145 |
| 3,625,272 | | 12/1971 | Fletcher | 152/357 |
| 3,726,078 | | 4/1973 | Nakamura | 57/145 |
| 3,950,590 | | 4/1976 | Edelman et al. | 428/395 |
| 4,158,946 | * | 6/1979 | Bourgois | 57/213 |
| 4,263,957 | | 4/1981 | Abe | 152/356 R |
| 4,349,062 | | 9/1982 | Tsurunaga et al. | 152/356 R |
| 4,488,587 | * | 12/1984 | Umezawa et al. | 152/359 |
| 4,628,683 | | 12/1986 | Bourgois et al. | 57/213 |
| 4,721,498 | | 1/1988 | Grob | 474/261 |
| 4,724,663 | | 2/1988 | Bourgois et al. | 57/15 |
| 4,749,016 | | 6/1988 | Kojima et al. | 152/527 |
| 4,962,803 | | 10/1990 | Welter | 152/541 |
| 5,050,657 | * | 9/1991 | Umezawa | 152/527 |
| 5,211,609 | | 5/1993 | Haines | 474/260 |
| 5,473,878 | * | 12/1995 | Hamiel et al. | 57/213 |
| 5,502,960 | | 4/1996 | Kobayashi et al. | 57/236 |
| 5,759,316 | | 6/1998 | Sawada | 152/556 |
| 5,772,808 | | 6/1998 | Kuriya | 152/454 |
| 5,802,829 | | 9/1998 | Yamanaka | 57/212 |

FOREIGN PATENT DOCUMENTS

| | | | |
|---|---|---|---|
| 11050383 | 2/1999 | (JP) | D07B/1/06 |
| 11061662 | 3/1999 | (JP) | D07B/1/06 |
| 11061663 | 3/1999 | (JP) | D07B/1/06 |
| 11061666 | 3/1999 | (JP) | D07B/1/06 |

* cited by examiner

*Primary Examiner*—Andy Falik
(74) *Attorney, Agent, or Firm*—David L King; Dan Whitman

(57) ABSTRACT

A steel cord (10) for reinforcing elastomeric articles. The steel cord (10) having a plurality of strands (14). Each strand (14) having a core (20) and a sheath (22). The sheath (22) being a plurality of steel filaments that are helically wrapped about the core (20). A first strand (16) extending longitudinally through the center of the steel cord (10). The remaining strands (18) being helically wrapped about the first strand (16). The core (20) of the first strand (16) being a plurality of filaments twisted together. In a preferred embodiment, the core (20) of the first strand 16 being three filaments twisted together.

12 Claims, 7 Drawing Sheets

STEEL CORD FOR REINFORCING ELASTOMERIC ARTICLES

TECHNICAL FIELD

This invention relates to steel cords for reinforcing elastomeric articles and, more particularly, to steel cords which form a portion of the carcass of an endless track.

BACKGROUND ART

The use of endless tracks on vehicles is becoming increasingly more popular, especially in agricultural applications. An endless track is a belt that has no distinct beginning or ending and is made of elastomeric materials reinforced by steel cords. The radially outermost portion of the track has a ground engaging tread, similar to that on a tire. The primary purpose of a track is to provide a larger surface area of contact between the vehicle and the ground. This is especially useful in keeping the vehicle afloat when running on soft surfaces, such as muddy ground.

The endless track generally contains multiple regions having steel cord reinforcement. A first steel cord reinforced region is the carcass. The carcass is an elastomeric layer having a circumferentially oriented steel cord. This steel cord lays in a longitudinal direction and is spirally wrapped around the circumference of the endless track from a first edge to a second edge. This cord carries substantially all of the tensile working load of the track, and as a result, is generally the thickest steel cord in the track. Typically, an endless track will have at least two plies positioned radially outwardly of the carcass. Each ply contains a steel wire reinforcement. The steel wire reinforcement of these plies is laid at a bias angle with respect to the equatorial plane of the track. The most common arrangement for these plies is that the steel wire reinforcement of the first ply is at an angle opposite the steel wire reinforcement of the second ply. Commonly a third ply will be placed radially outwardly of the bias angled plies. The steel wire reinforcement of this third ply generally is laid at an angle perpendicular to the equatorial plane.

Currently, the steel cord reinforcing the carcass is formed from seven strands of seven steel wires. As shown in FIG. 1, each strand includes a single core wire that is helically wrapped by a sheath of six wires. A first strand then makes up the core of the steel cord and the six remaining strands are helically wrapped around the first strand to form the completed steel cord.

Although the current steel cord construction provides sufficient support to handle the tensile working load of the track, the cord experiences a problem known as "wire migration." The wire forming the core of the first stand of the cord tends to break after being subjected to the bending stresses of an extended service life. After continued service, an end of the broken wire migrates through the surrounding sheath and remaining strands and punctures the elastomeric material forming part of the carcass. As a result, the end of the broken wire protrudes from the track. Although the protruding wire does not cause a failure of the track, the protruding wire reduces the aesthetics of the track and may open a passageway for moisture to penetrate to the steel cord.

SUMMARY OF THE INVENTION

This invention provides to a steel cord for reinforcing elastomeric articles. The steel cord has a plurality of strands. Each strand has a core and a sheath. The sheath is a plurality of steel filaments helically wrapped about the core. A first strand extends longitudinally through the center of the cord. The remaining strands are helically wrapped about the first strand. The core of the first strand is a plurality of filaments twisted together.

In the preferred embodiment, three filaments form the core of the first strand. These three filaments are twisted in an S-direction at a lay length of 7 mm. The sheath of the first strand is helically wound about the core in an S-direction at a lay length of 14 mm. The sheath of each remaining strand is helically wound about the core of the respective remaining stand in a Z-direction at a lay length of 29 mm. The remaining strands are helically wound about the first strand in an S-direction at a lay length of 40 mm.

Definitions

For ease of understanding this disclosure, the following terms are disclosed.

"Carcass" means the first reinforced layer of the track located radially outwardly of the interior surface of the track. The carcass is an elastomeric layer having steel cord reinforcement. The steel cord reinforcement is generally spirally wrapped around the circumference of the track and travels from a first edge to a second edge.

"Circumferential" means lines or directions extending along the perimeter of the track surface parallel to the equatorial plane and perpendicular to the axial direction.

"Cord" denotes a plurality of bundles or strands of grouped filaments of high modulus material.

"Equatorial Plane (EP)" means the plane perpendicular to the axial direction of the track and passing through the center of the track.

"Lay length" means the distance at which a twisted filament or strand travels to make a 360 degree rotation about another filament or strand.

"Longitudinal" means in a circumferential direction.

"Ply" means a continuous layer of elastomeric material having parallel cords.

"Radial" or "radially" mean directions toward or away from the centroid of the track. The centroid of the track is located at the intersection of a line drawn from the upper and lower sections of the track and the forward and rear sections of the track when mounted on a drive device.

BRIEF DESCRIPTION OF DRAWINGS

The invention will be described by way of example and with reference to the accompanying drawings in which.

DETAILED DESCRIPTION OF THE INVENTION

Figure 1:
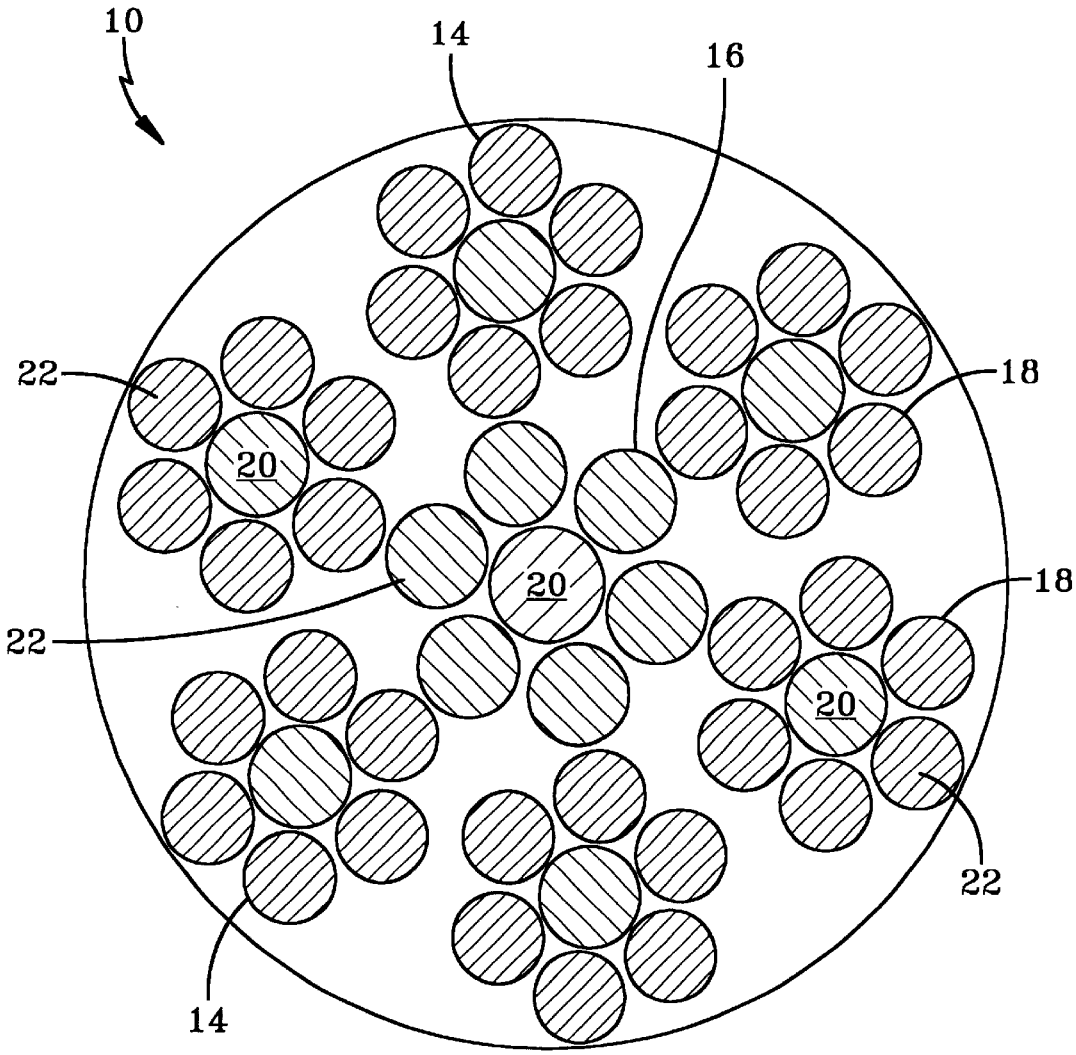
FIG-1 PRIOR ART
FIG. 1 is a cross-section of the prior art steel cord.
Figure 2:
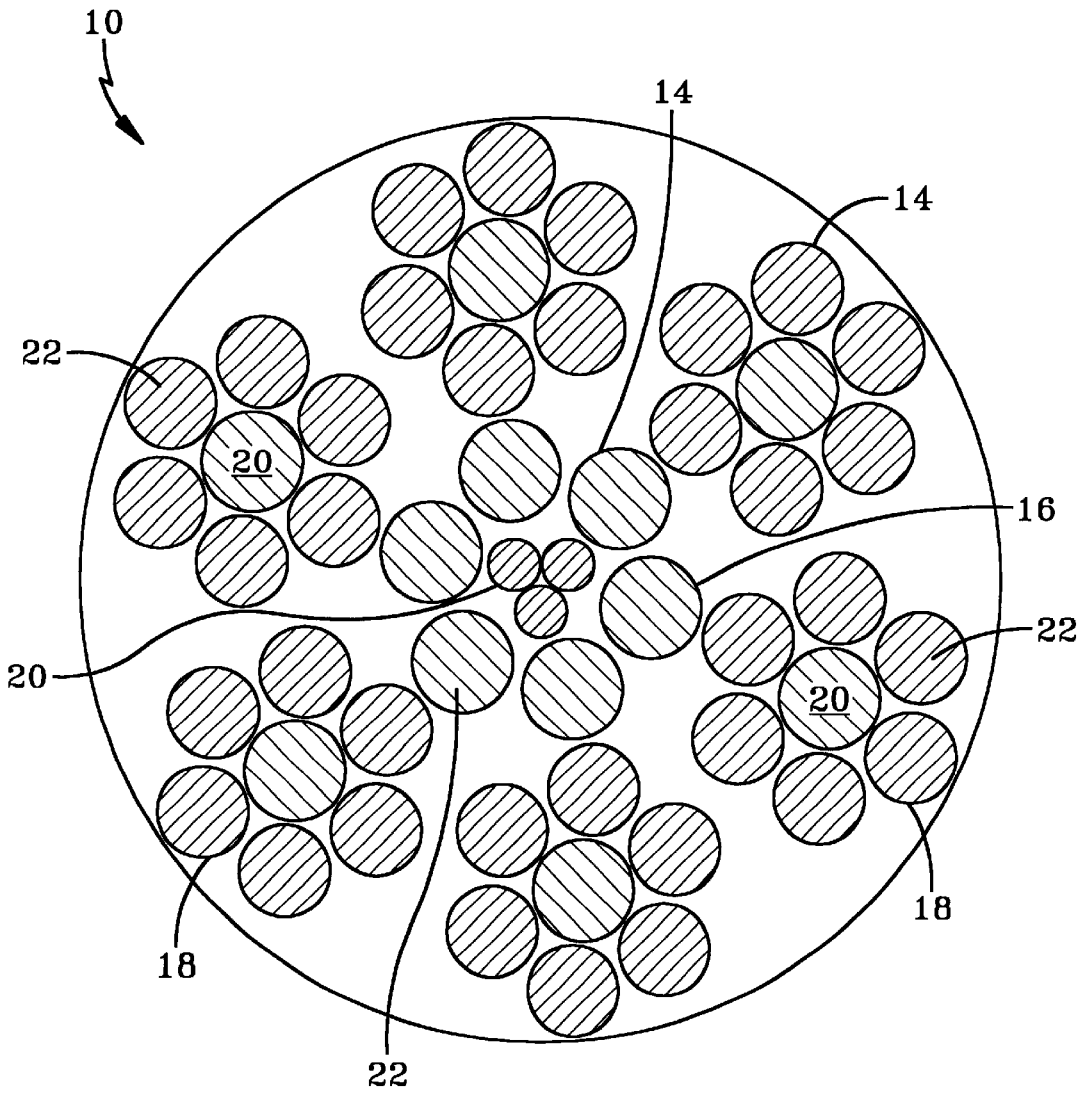
FIG. 2 is a cross-sectional view of the steel cord of the invention.

FIG. 2 shows a cross-sectional view of an embodiment of the steel cord 10 of the invention. The steel cord 10 is used for reinforcing elastomeric articles such as the endless track 12 shown in FIG. 6. As can be seen in FIG. 1 the steel cord has a plurality of strands 14. A first strand 16 is located at the center of the cord 10 and extends longitudinally through the cord 10. The remaining strands 18 wrap helically around the first strand 16 to form the cord 10. Each strand 14 has a core 20 and a sheath 22. The sheath 22 of each strand 14 is wrapped helically about the core 20 of the strand 14.

As seen in FIG. 2 the core 20 of the first strand 16 consists of a plurality of filaments which are twisted together. The twisting of a plurality of filaments to form the core 20 of the first strand 16 eliminates migration of the core 20 of first strand 16. The twisted filaments hold one another in place so that if one of the respective filaments breaks the filament will be held in place and prevented from migrating by the other respective filaments. An additional benefit of the twisted filaments forming the core 20 of the first strand 16 is that the twisted filaments increase the fatigue resistance of the core 20. Thus, the core 20 of first strand 16 is less likely to break after repeated bending.

The remaining strands 18 of the steel cord 10 shown in FIG. 2 contain a single filament core 20 which is covered by a sheath 22 formed from a plurality of filaments helically wound about the core 20. The filament forming the core 20 of the remaining strands 18 has a larger diameter than each filament used to form the core 20 of the first strand 16, but a diameter similar to that of the filaments of the sheath 22 of the first strand 16.

Figure 3:
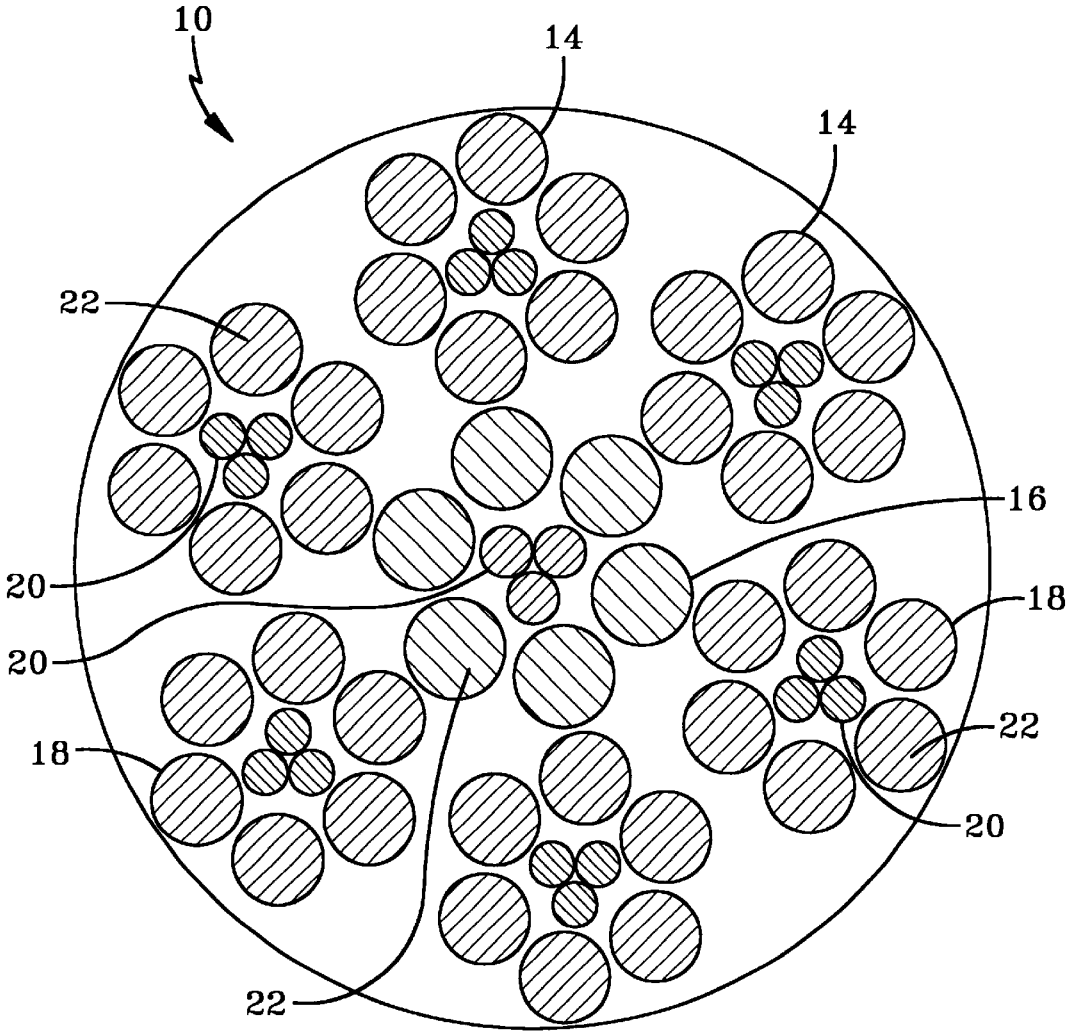
FIG. 3 is a cross-sectional view of a second embodiment of the invention.

FIG. 3 shows a cross-sectional view of a second embodiment of the steel cord 10 of the invention. The first strand 16 is constructed similar to the first strand shown in FIG. 2 in that it contains a core 20 formed of a plurality of filaments twisted together surrounded by a sheath 22 formed from a plurality of filaments helically wound about the core 20. The remaining strands 18 in FIG. 3 also have a core 20 comprised of a plurality of filaments twisted together, similar to the construction of the core 20 of the first strand 16. This construction provides additional fatigue resistance for not only the core 20 of the first strand 16 but also the core 20 of each remaining strand 18.

Figure 4:
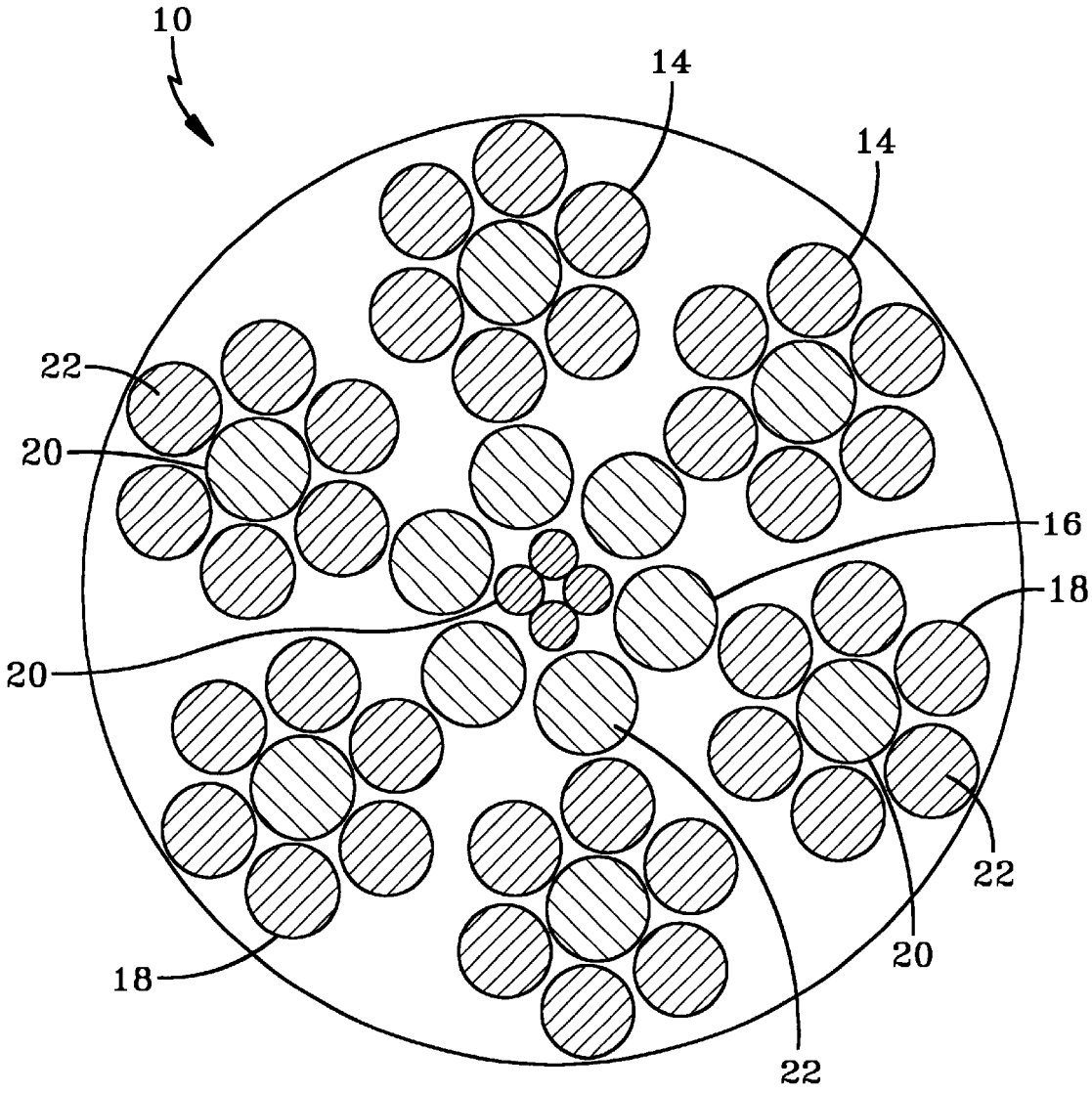
FIG. 4 is a cross section of a third embodiment of the invention.
Figure 5:
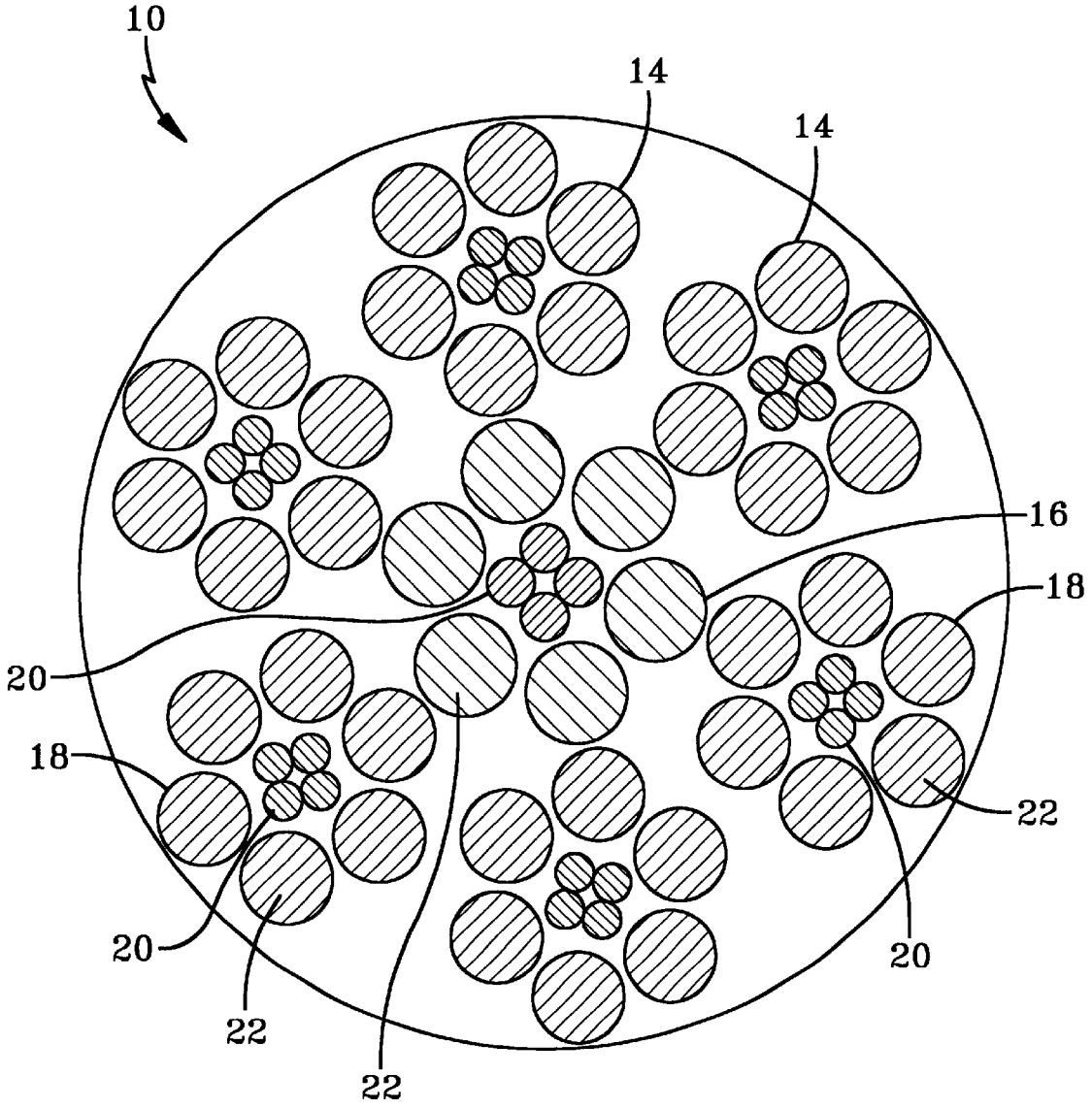
FIG. 5 is a cross-sectional view of the fourth embodiment of the invention.

FIG. 4 and FIG. 5 show cross-sectional views of additional embodiments of the cord of the invention. FIG. 4 shows a cord 10 where the first strand 16 has a core made up of four filaments twisted together. The remaining strands 18 of FIG. 4 consist of strands having a single filament core 20. The first strand 16 of FIG. 5 has the identical construction of that shown in FIG. 4. The remaining strands 18 of FIG. 5 show a core 20 formed from four filaments twisted together.

Although the core 20 of the first strand 16 can be made of any number of filaments twisted together, in a preferred embodiment, the core 20 is formed from three filaments. Forming the core 20 of the first strand 16 from three filaments allows each filament to be in contact with each other filament forming the core 20. By allowing each filament to be in contact with each other filament in the core, any gapping that could form between the respective filaments is minimized. An additional benefit of forming the core 20 from three filaments is that the shape of the core 20 becomes dimensionally sufficient to fill the area internal of the sheath 22. When the core 20 is made of only two filaments, the core 20 has a long and narrow shape causing the first strand to become more elliptical in shape than when three filaments are used to form the core 20.

The core of the remaining strands 18 can contain any number of filaments. However, the core 20 of the remaining strands 18 preferably contains either one filament as shown in FIG. 2, or with three filaments, as shown in FIG. 3. Forming the core 20 of the remaining strands 18 with one or three filaments provides a shape of the core 20 that is easily covered by the sheath 22.

The term "lay length" as used herein with respect to the filaments in the core 20 is the distance along the length of the cord in which one of the filaments in the core 20 makes a complete (360°) revolution around the outside of the core of the filaments making up the core.

The term lay length as used herein with respect to the group of filaments in the sheath 22 is the distance along the outside of the cord 10 in which one of the filament in the sheath makes a complete (360°) revolution around the outside of the cord 10. The group of filaments are twisted with respect to the cord 10 axis, but they are parallel to each other.

The diameter of each filament in the cord 10 may range from about 0.20 mm to 0.70 mm. Preferably, the diameter of the filament ranges from 0.26 mm to 0.35 mm.

The intended use of the cord of the present invention is in a rubber-reinforced article. Such articles will incorporate the cord of the present invention and which will be impregnated with rubber as known to those skilled in the art. Representative of articles may use the cord of the present invention include belts, tires, tracks, and hoses. In the most preferred application, the cord of the present invention is used in a track.

Figure 7:
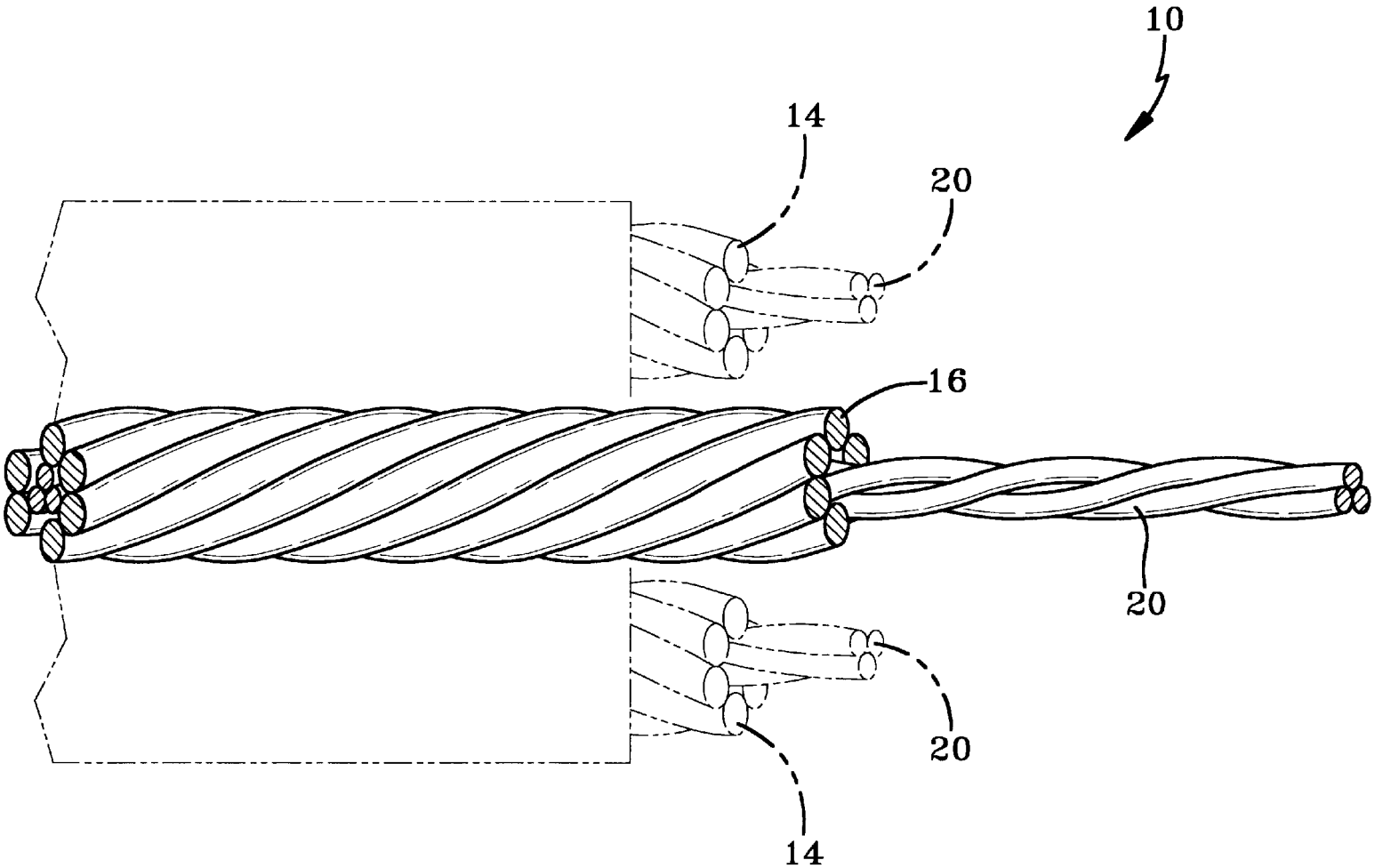
FIG. 7 is a view showing an exemplary embodiment of the invention wherein the core of the first strand has a lay length different than the lay length of the filaments of the sheath of the first strand.

The preferred embodiment of the invention is depicted in FIG. 2. In this preferred embodiment, the core 20 of the first strand 16 is formed of three filaments twisted together. This core 20 is then helically wrapped by a sheath formed of six filaments. The core 20 of the remaining strands 18 is formed by a single filament. This core 20 of the remaining strands 18 is helically wrapped by a sheath 22 formed from six filaments. Ideally, the steel filaments forming the core 20 of the first strand 16 are twisted in an S direction at a lay length of 7 millimeters. The sheath 22 of the first strand 16 is helically wound about the core 20 in an S direction at a lay length of 14 millimeters. As shown in FIG. 7, the first strand 16, can have the lay length of the core of the first strand being different than the lay length of the filaments of the sheath of the first strand. The core 20 of each remaining strand is formed from a single untwisted filament. The sheath 22 of each of these remaining strands 18 is helically wound about the respective core 20 in a Z direction at a lay length of 29 millimeters. The remaining strands 18 are then helically wound about the first strand in an S direction at a lay length of 40 millimeters. In this preferred embodiment, each of the fragments forming the sheath 22 of the first strand are equal in diameter to the filaments forming the core 20 of the remaining strands 18. Each of the filaments forming the sheath 22 of the first strand 16 is greater in diameter than each of the filaments forming the sheath 22 of the remaining strands 18.

In forming the steel cord depicted in FIG. 3, the construction and lay lengths of the first strand are preferably identical to that described in the preferred embodiment of FIG. 2. In forming the core 20 of the remaining strands 18, the core 20 is ideally formed of three filaments twisted together in a Z direction with a lay length of 14 millimeters. The diameter of each filament of the core 20 of the first strand 16 is larger than the diameter of each filament forming the core 20 of the remaining strands 18. Each filament forming the sheath 22 of the first strand 16 has a diameter larger than each filament forming the sheath 22 of the remaining strands 18.

The prior art tracks employ a wire construction of 7×7/5.4 mm:(1×0.74+6×0.63)+6×(0.63+6×0.57) or 7×7/4.1 mm:(1×0.55+6×0.48)+6×(0.48+6×0.45).

One embodiment track of the present invention as depicted in FIG. 2 employed a wire cord 10 5.3 mm:(3×0.35+6×0.63)+6×(0.63+6×0.57); 7S/14S/29Z/40S.

Another embodiment track of the present invention employed a wire construction 4.1 mm:(3×0.26+6×0.48)+6×(0.48+6×0.44); 7S/14S/22Z/32S.

Each of the tracks described above are simply exemplary of the constructions possible according to FIG. 2. These construction wire and filament sizes can also be in the examples provided in FIGS. 3, 4 and 5 as illustrated.

Figure 6:
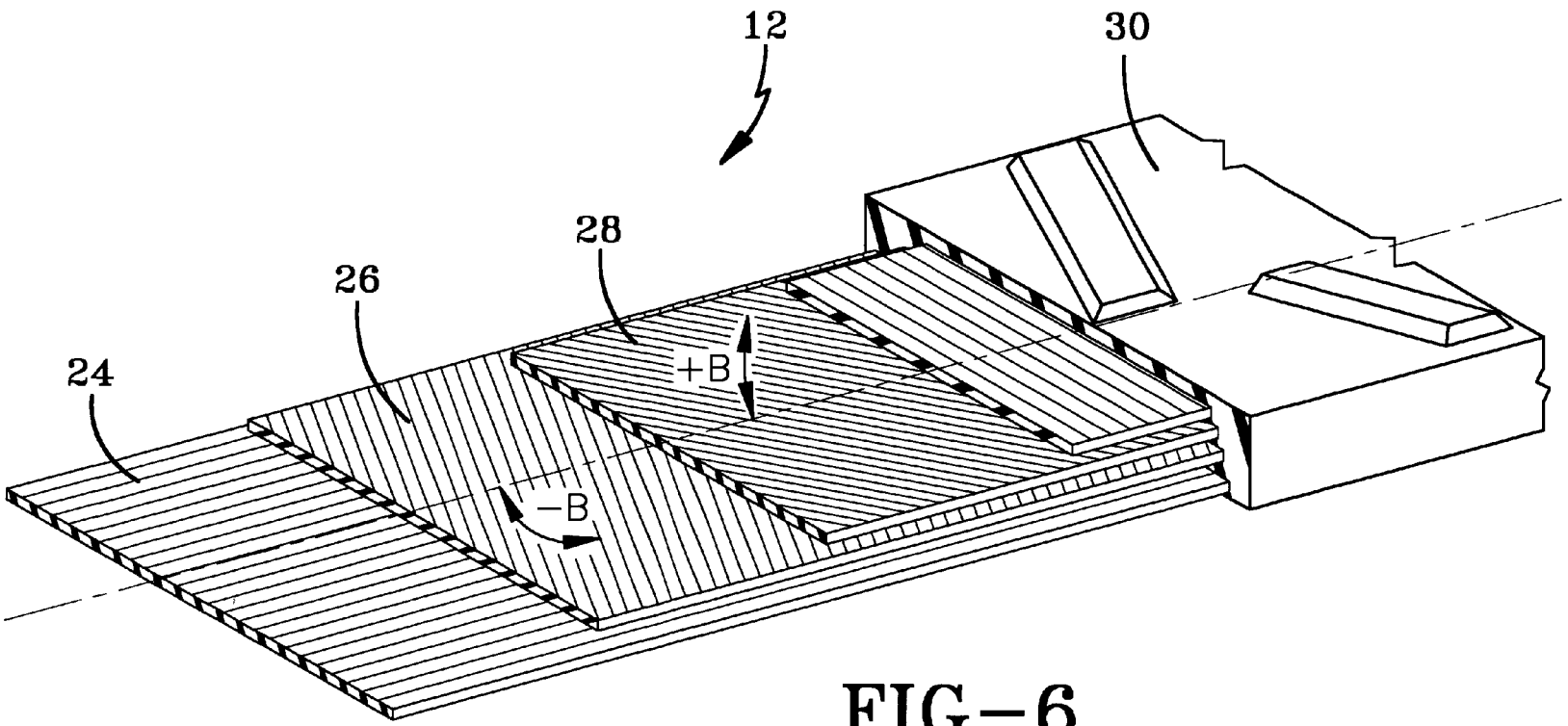
FIG. 6 is a cut-away view of a portion of an endless track.

FIG. 6 shows a cut-away of a portion of an endless track, such as would be used in an agricultural setting. The endless track 12 is formed from multiple layers of reinforced elastomeric material. The carcass 24 is the first layer of reinforced elastomeric material encountered as one moves radially outwardly from the inner surface of the track. Generally, a track 12 will also have at least two other reinforced layers that are located radially outwardly of the carcass 24. These two layers, known as the first ply 26 and the second ply 28, have cords that are angled at an angle β from the equatorial plane of the track 12. The first ply is angled at an angle of β from the equatorial plane; whereas, the second ply 28 is angled at the angle of β from the equatorial plane in the opposite direction from the first ply 26. Radially outwardly of the plies on the track is located the tread 30.

The steel cord 10 of this invention will ideally form the reinforcement for the carcass 24 of the track 12. However, depending upon the size of the endless track 12 and the environment such track is subject to, the cord 10 of this invention may be used to reinforce any of these reinforced layers of the track 12.

What is claimed is:

1. A steel cord for reinforcing elastomeric articles, the steel cord having a plurality of strands, each strand having a core and a sheath, the sheath being a plurality of steel filaments helically wrapped about the core, a first strand extending longitudinally through the center of the steel cord, the remaining strands being helically wrapped about the first strand, the steel cord being characterized in that:

the core of the first strand being a plurality of filaments twisted together; and wherein the first strand being a core of three filaments wrapped by a sheath of six filaments and the remaining strands being a core of one filament wrapped by a sheath of six filaments.

2. A steel cord as in claim 1 characterized in that:

the steel cord being a portion of a carcass for an endless track.

3. A steel cord as in claim 1 characterized in that:

the core of the remaining strands being a plurality of filaments twisted together.

4. A steel cord as in claim 1 wherein the core of the first strand has a lay length, the lay length being different than the lay length of the filaments of the sheath of the first strand.

5. A steel cord for reinforcing elastomeric articles, the steel cord having a plurality of strands, each strand having a core and a sheath, the sheath being a plurality of steel filaments helically wrapped about the core, a first strand extending longitudinally through the center of the steel cord, the remaining strands being helically wrapped about the first strand, the steel cord being characterized in that:

the core of the first strand being a plurality of filaments twisted together; and wherein the plurality of steel filaments in the core of the first strand being twisted in an S-direction at a lay lenght of 7 mm.

6. A steel cord for reinforcing elastomeric articles, the steel cord having a plurality of strands, each strand having a core and a sheath, the sheath being a plurality of steel filaments helically wrapped about the core, a first strand extending longitudinally through the center of the steel cord, the remaining strands, being helically wrapped about the first strand the steel cord being characterized in that:

the core of the first strand being a plurality of filaments twisted together; and wherein the sheath of the first strand being helically wound about the core of the first strand in an S-direction at a lay length of 14 mm.

7. A steel cord for reinforcing elastomeric articles, the steel cord having a plurality of strands, each strand having a core and a sheath, the sheath being a plurality of steel filaments helically wrapped about the core, a first strand extending longitudinally through the center of the steel cord, the remaining strands being helically wrapped about the first strand, the steel cord being characterized in that:

the core of the first strand being a plurality of filaments twisted together; and wherein the sheath of each of the remaining strands being helically wound about the respective core in a Z-direction at a lay length of 29 mm.

8. A steel cord for reinforcing elastomeric articles, the steel cord having a plurality of strands, each strand having a core and a sheath, the sheath being a plurality of steel filaments helically wrapped about the core, a first strand extending longitudinally through the center of the steel cord, the remaining strands being helically wrapped about the first strand, the steel cord being characterized in that:

the core of the first strand being a plurality of filaments twisted together; and wherein the remaining strands being helically wound about the first strand in an S-direction at a lay length of 40 mm.

9. A steel cord for reinforcing elastomeric articles, the steel cord having a plurality of strands, each strand having a core and a sheath, the sheath being a plurality of steel filaments helically wrapped about the core, a first strand extending longitudinally through the center of the steel cord, the remaining strands being helically wrapped about the first strand, the steel cord being characterized in that:

the core of the first strand being a plurality of filaments twisted together; and wherein each of the filaments forming the sheath of the first strand being equal in diameter to a filament forming the core of the remaining strands.

10. A steel cord for reinforcing elastomeric articles, the steel cord having a plurality of strands, each strand having a core and a sheath, the sheath being a plurality of steel filaments helically wrapped about the core, a first strand extending longitudinally through the center of the steel cord, the remaining strands being helically wrapped about the first strand, the steel cord being characterized in that:

the core of the first strand being a plurality of filaments twisted together; and wherein each of the filaments forming the sheath of the first strand being greater in diameter than each of the filaments forming the sheaths of the remaining strands.

11. A steel cord for reinforcing elastomeric articles, the steel cord having a plurality of strands, each strand having a core and a sheath, the sheath being a plurality of steel filaments helically wrapped about the core, a first strand extending longitudinally through the center of the steel cord, the remaining strands being helically wrapped about the first strand, the steel cord being characterized in that:

the core of the first strand and the core of the remaining strands being a plurality of filaments twisted together, the first strand being a core of three filaments wrapped by a sheath of six filaments and the remaining strands being a core of three filaments wrapped by a sheath of six filaments.

12. A steel cord for reinforcing elastomeric articles, the steel cord having a plurality of strands, each strand having a core and a sheath, the sheath being a plurality of steel filaments helically wrapped about the core, a first strand extending longitudinally through the center of the steel cord, the remaining strands being helically wrapped about the first strand, the steel cord being characterized in that:

the core of the first strand being a plurality of filaments twisted together, and the core of the remaining strands being a core of three filaments, the three filaments of the core of the remaining strands being twisted in a Z-direction at a lay length of 14 mm.

* * * * *